US005337728A

United States Patent [19]

Maruyama

[11] Patent Number: 5,337,728

[45] Date of Patent: Aug. 16, 1994

[54] LIQUID HEATING APPARATUS

[76] Inventor: Noboru Maruyama, 2-26-14 Shirasagi, Nakano-ku, Tokyo, Japan

[21] Appl. No.: 42,612

[22] Filed: Apr. 2, 1993

[30] Foreign Application Priority Data

Apr. 27, 1992 [JP] Japan ..... 4-107642

[51] Int. Cl.[5] ..... F24H 1/00

[52] U.S. Cl. ..... 126/344; 126/390; 126/389; 126/279; 122/234

[58] Field of Search ..... 126/344, 373, 365, 390, 126/391, 392, 101, 103, 389, 312, 279, 80; 122/13.1, 42, 58 R, 111, 17, 16, 234, 494

[56] References Cited

U.S. PATENT DOCUMENTS

| | | | |
|---|---|---|---|
| 2,790,428 | 4/1957 | Buttler | 122/17 |
| 2,888,911 | 6/1959 | Thompson | 122/17 X |
| 3,490,420 | 1/1970 | Kramer | 122/17 |
| 4,401,058 | 8/1983 | Charrier et al. | 122/17 |
| 4,479,484 | 10/1984 | Davis | 122/17 X |

*Primary Examiner*—Larry Jones

*Attorney, Agent, or Firm*—Gunn & Kuffner

[57] ABSTRACT

In a liquid heating apparatus according to the present invention, an internal drum is arranged at a space from and in an external drum, a combustion gas descending chamber is provided therebetween, an outer water chamber having a hot water outlet port and a water supply port in the upper and lower sections thereof is provided outside the combustion gas descending chamber, an inner water chamber communicating with communicating tubes in the upper and lower sections to the outer water chamber is provided inside the combustion gas descending chamber, a combustion chamber communicating to the combustion gas descending chamber in the upper section is provided inside the internal drum, and exhaust port is provided under the combustion gas descending chamber, a smoke collecting chamber having a larger cross-sectional area than that of said exhaust port is provided under the exhaust port, and a smoke exhaust port is provided in this smoke collecting chamber.

9 Claims, 2 Drawing Sheets

LIQUID HEATING APPARATUS

BACKGROUND OF THE INVENTION

This invention relates to a liquid heating apparatus, such as a boiler, utilizing an ascendant/descendant flowing system of a combustion gas.

The liquid heating apparatus as described above includes for instance, that which this applicant proposed in Japanese Utility Model Publication No. 15168/1956, is as shown in FIGS. 1 and 2. In this apparatus, an internal drum 22 comprising a dual wall is arranged in and at a space from an external drum 21 comprising a dual wall, with a combustion gas descending chamber 23 provided therebetween. An outer water chamber 26 having a hot water outlet port 24 and a water inlet port 25 in the upper and lower sections thereof respectively is provided outside this combustion gas descending chamber 23. An inner water chamber 27 communicated to the outer water chamber 26 with the upper and lower communicating tubes 28 is provided inside the combustion gas descending chamber 23. A combustion chamber 29 communicated to the combustion gas descending chamber 23 in the upper section thereof is provided in the internal drum 22. An exhaust port 30 is provided under the combustion gas descending chamber 23, a flue 33 is communicated to this exhaust port 30. A combustor 32 is detachably mounted through the inner and outer water chambers 26 and 27. It should be noted that the numeral 34 indicates a clearing port. In the liquid heating apparatus as described above, the combustion gas successively heated by the combustor 32 rises upwardly through the combustion chamber 29, the radiant heat being absorbed therein, and then the combustion gas is inverted in the upper section thereof such that the gas flows down through the combustion gas descending chamber 23 at a flow velocity g (m/sec). The flow velocity is increased to a velocity G (m/sec) at the exhaust port 30, and is exhausted to the flue 33. During this process, the combustion gas rapidly raises the temperature of the liquid by delivering the heat through radiation or contact to the liquid in the inner and outer water chambers 26 and 27 and raising the heat exchange rate between the combustion gas and the liquid. At the same time the descending fluidity is raised and the combustion efficiency is improved, so that incomplete combustion is advantageously prevented.

Although the conventional type of liquid heating apparatus provides the advantage as described above, it has the following problem. Namely, this liquid heating apparatus is as described above, and a flow path for a combustion gas in the combustion gas descending chamber 23 is narrow so that delivery of heat is efficiently carried out through contact by the combustion gas. In other words;

(1) The combustion gas flows downwardly through the narrow flow path of the exhaust port 30 flows laterally at a substantially right angle with the flow velocity G as described above, via the flue 33 communicated to the exhaust port 30; and furthermore flows upward at substantially right angles outside the external drum 21, thereby generating an extremely large air exhaust resistance. This air exhaust resistance prevents the combustion gas from smoothly flowing, and the expected effect can not be achieved, which is a problem to be solved.

(2) If cross-sectional areas of the exhaust port 30 and the flue 33 are made larger to solve this problem by smoothly flowing the combustion gas overcoming the large exhaust resistance, disturbance comes in at a flow velocity of V (m/sec) from an exhaust port of the flue 33 as indicated by the arrow mark in FIG. 1. Furthermore, if the flow velocity V is less than the flow velocity G of the combustion gas ($V<G$), normal combustion is maintained, but in case of $V>G$, disturbance comes into the combustion chamber 29, which prevents normal combustion. When the combuster 12 is in operation, the draft power in the flue 33 is generally expressed by the equation of $Df \propto H \times (Tgm - To)$ (wherein Df is draft power, H is height, Tgm is an average temperature in the flue 33, and To is a temperature of peripheral air). Where the flue 33 has a large cross-sectional area, the quantity of heat radiated from the surface of the flue increases and the draft power is decreased, causing a load effect on combustion. When combustion is stopped, external air comes in from an opened exit of the flue 33 having a large cross-sectional area, which cools a heat insulation gas residing in the apparatus and generates convection therein. Then the heat insulation gas is exhausted via the flue 33 to outside and the temperature decreases. In such a system as an automatic hot water supply system, the combustor 9 operates to restart unnecessary heating, which results in wasted of energy and an increase in the operating cost. In addition, combustion state in the apparatus becomes unstable to interrupt combustion in the combustor 32 or generate oscillating combustion as well as to generated noises, which is another problem to be solved.

SUMMARY OF THE INVENTION

An object of the present invention is to solve the problems in the conventional type of liquid heating apparatus as described above, by providing a liquid heating apparatus wherein a combustion gas can smoothly flow without generating a large exhaust resistance when the combustion gas is exhausted, an external disturbance can hardly come into a flue from the exhaust port even if cross-sectional areas of the exhaust port and the flue are not increased, and accordingly an external disturbance does not enter, as it is, the combustion gas descending chamber or the combustion chamber to disturb the combustion state, nor is any noise is generated therein.

To achieve the object as described above, a liquid heating apparatus according to the present invention has; an internal drum provided at a space from and in an external drum; a combustion gas descending chamber provided therebetween; an outer water chamber having a hot water outlet port and a water inlet port in the upper and lower sections thereof respectively provided outside the combustion gas descending chamber; an inner water chamber communicating with the communicating tubes in the upper and lower sections thereof to the outer water chamber provided inside the combustion gas descending chamber; a combustion chamber communicating to the aforesaid combustion gas descending chamber in the upper section provided inside the internal drum; and an exhaust port under the combustion gas descending chamber as in the conventional type of hot water supply apparatus; is characterized in that a smoke collecting chamber having a larger cross-sectional area than that of said exhaust port is provided under said exhaust port and a smoke exhaust port is provided in this smoke collecting chamber. The smoke exhaust port is provided in the side section or at the bottom of the smoke collecting chamber.

In the liquid heating apparatus according to the present invention as described above, a combustion gas flowing upward in the combustion chamber is inverted at the top of the combustion chamber and descends through the combustion gas descending chamber. During this process, the combustion gas supplies a liquid inside the inner and outer water chambers with heat, thus the descending fluidity being improved with the combustion efficiency raised, which prevents incomplete combustion and raises the temperature of the liquid by raising the heat exchange rate between the combustion gas and the liquid. The high flow velocity of the combustion gas exhausted from the exhaust port to the smoke collecting chamber is reduced because the cross-sectional area of said smoke collecting chamber is larger than that of the exhaust port. A portion of the dynamic pressure, according to the difference in cross-sectional area, changes to a static pressure, which maintains the discharge pressure to the exhaust port. For this reason, when an external disturbance comes into the smoke collecting chamber from an exhaust port of the flue, the flow velocity decreases and the external disturbance is dispersed and weakened.

DESCRIPTION OF THE PREFERRED EMBODIMENT

Figure 1:
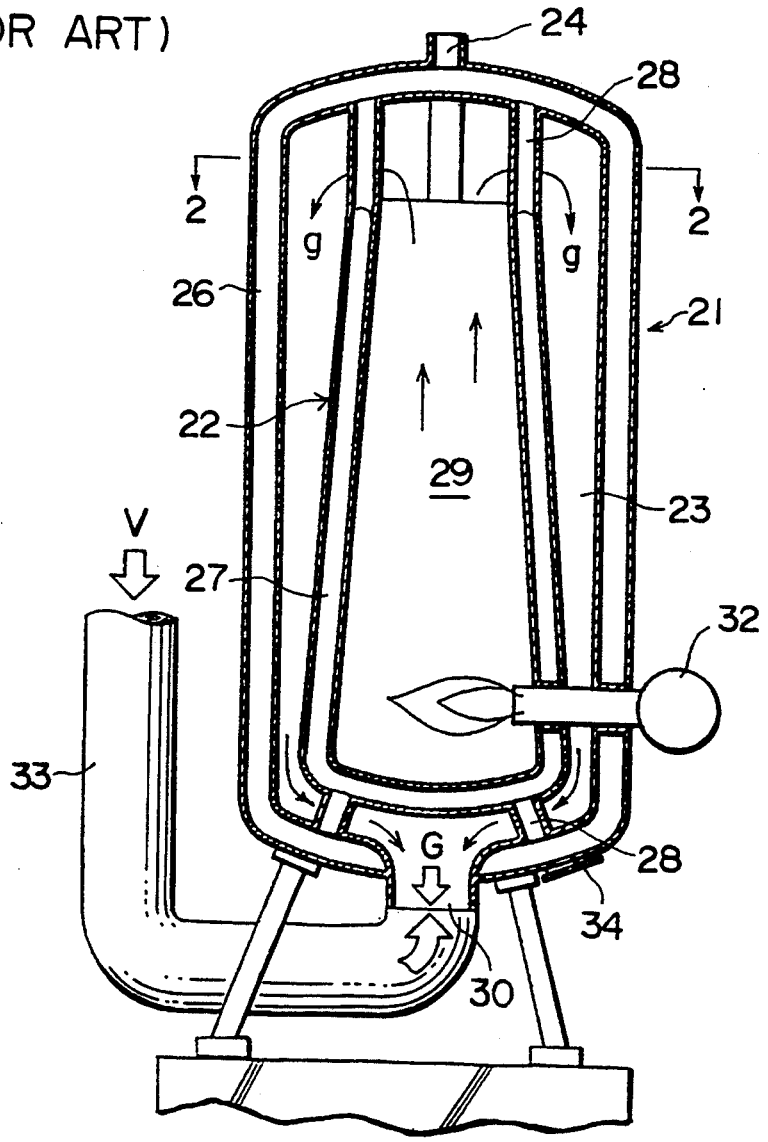
FIG. 1 (PRIOR ART)
FIG. 1 is a cross section of a conventional type of liquid heating apparatus, viewed from the front side in the longitudinal direction.
Figure 2:
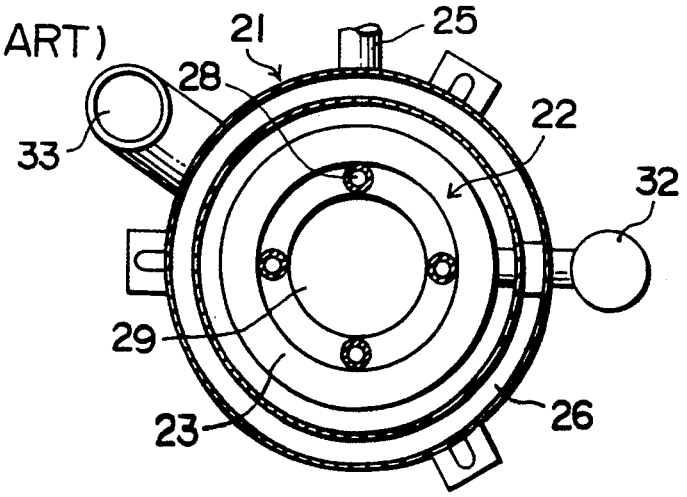
FIG. 2 (PRIOR ART)
FIG. 2 is a cross section of the same taken along the line 2—2 in FIG. 1.
Figure 3:
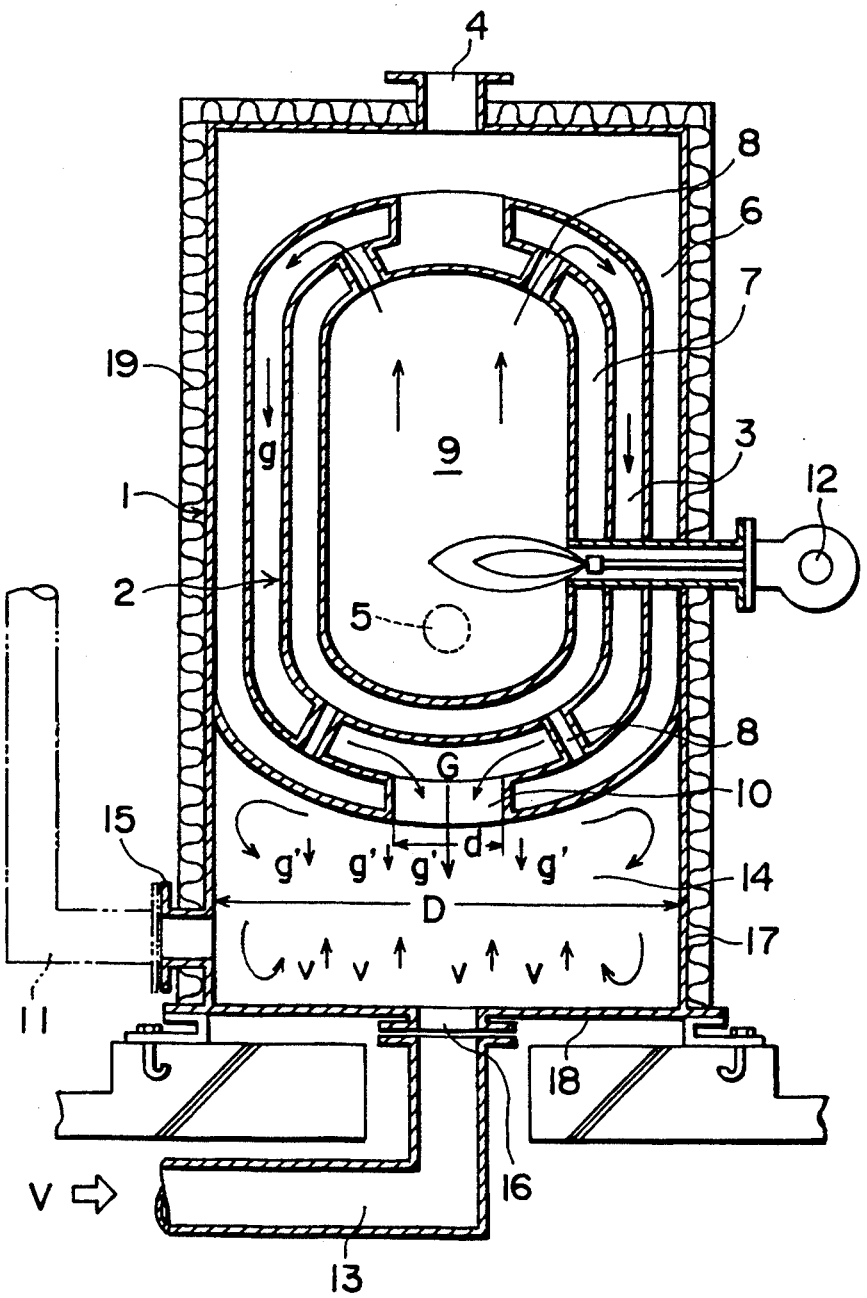
FIG. 3 is a cross section of a liquid heating apparatus according to an embodiment of the present invention, viewed from the front side in the longitudinal direction.

In the embodiment of the present invention shown in FIG. 3, the numeral 1 indicates an external drum of vessel comprising a dual wall, an internal drum 2 comprising a dual wall is arranged at a space from and in the external drum 1, a combustion gas descending chamber 3 is provided therebetween, an outer water chamber 6 having an hot water outlet port 4 and a water supply port 5 in the upper and lower sections thereof respectively is provided outside the combustion gas descending chamber 3, an inner water chamber 7 communicating with communicating tubes 8 in the upper and lower sections thereof to the outer water chamber 6 is provided inside the combustion gas descending chamber, a combustion chamber 9 communicating in the upper section to the combustion gas descending chamber 3 is provided inside the internal drum 2, an exhaust port 10 is provided under the combustion gas descending chamber 3, a flue 13 is communicated to this exhaust port 10, and a combustor 12 is detachably mounted through the inner and outer water chambers 6 and 7. In this type of a liquid heating apparatus, like the conventional one as described above, a combustion gas flowing upwardly in the combustion chamber 9 is inverted at the top and descends through the combustion gas descending chamber 3. During this process the combustion gas supplies a liquid inside the inner and outer water chambers 6 and 7 adequate with heat so that the descending fluidity is improved with the combustion efficiency raised. This prevents incomplete combustion and raises the heat exchange rate between the combustion gas and the liquid, whereby the temperature of the liquid is rapidly raised.

In this invention, an external wall of the external drum 1 is extended downward to form a smoke collecting chamber 14 therein with the extended peripheral wall 17, smoke exhaust ports 15 and 16 are provided in the peripheral wall 17 and the bottom wall 18 of the smoke collecting chamber 14, and flues 11 and 13 are detachably mounted on the smoke exhaust ports 15 and 16. It should be noted that the peripheral wall may be formed as a separated body from the external drum and mounted to the external drum 1, and either one of the smoke exhaust ports 15 and 16 may be omitted. With the construction as described above, a cross-sectional area of the smoke collecting chamber 14 is larger than a cross-sectional area of the exhaust port 10. The cross-sectional area of the smoke collecting chamber and the exhaust port are functions of the their diameters, D and d, respectively. Results of an experiment show that the relation between the smoke collecting chamber diameter, D, and the exhaust port diameter, d, should preferably be the one expressed by the equation of $D \geqq \sqrt{1.5} \times d$. In the liquid heating apparatus having the construction as described above, the combustion gas flows downwardly at a high flow velocity g through the combustion gas descending chamber 3. The flow velocity increases to the flow velocity G at the exhaust port 30 and is discharged from the exhaust port 10 to the smoke collecting chamber 14. The flow velocity g is reduced to which is lower than g because the cross-sectional area of said smoke collecting chamber 14 is larger than that of the exhaust port 10. In this manner dynamic pressure according to the difference is changed to a static pressure which maintains a discharge pressure to the exhaust port 10. If an external disturbance having the flow velocity of V comes into the smoke collecting chamber 14 from the exhaust port of the flue 33, the flow velocity V is reduced to a flow velocity v which is smaller than V, the external disturbance being dispersed and weakened. It should be noted that the numeral 19 in the figure indicates a heat insulating material which covers the external drum 1.

According to the present invention; an internal drum is arranged at a space from and in an external drum: a combustion gas descending chamber is provided therebetween; an outer water chamber having a hot water outlet port and a water supply port in the upper and lower sections thereof is provided outside the combustion gas descending chamber; an inner water chamber communicating with communicating tubes in the upper and lower sections thereof to the outer water chamber is provided inside the combustion gas descending chamber; a combustion chamber communicating to the aforesaid combustion gas descending chamber in the upper section is provided inside the internal drum; an exhaust port is provided under the combustion gas descending chamber; a smoke collecting chamber having a larger cross-sectional area than said exhaust port is provided under the aforesaid exhaust port; and a smoke exhaust port is provided in the side section or at the bottom of the smoke collecting chamber. In this matter, the combustion gas can smoothly flow without generating a large exhaust resistance when the combustion gas is exhausted and an external disturbance can hardly enter from the exhaust port of the flue even if cross-sectional areas of the exhaust port and the flue are not expanded. Accordingly the external disturbance does not enter the combustion gas descending chamber nor the combustion chamber as it is, which prevents energy from being wasted and the operating cost from increasing. This apparatus also prevents disruption of combustion in the combustor due to unstable combustion conditions in the apparatus. Therefore, the present invention prevents not only generation of oscillating combustion but also generation of noise.

What is claimed is:

1. A liquid heating apparatus comprising:

an external drum;

an internal drum arranged at a spaced distance from and inside the external drum;

wherein the space between the external drum and the internal drum defines a combustion gas descending chamber;

an outer water chamber having a hot water outlet port and a water supply port in the upper and lower sections thereof respectively, said outer water chamber disposed outside the combustion gas descending chamber, an inner water chamber communicating with communicating tubes in the upper and lower sections thereof to the outer water chamber, said inner water chamber disposed inside said combustion gas descending chamber, a combustion chamber communicating to the aforesaid combustion gas descending chamber in the upper section thereof, said combustion chamber disposed inside the internal drum, an exhaust port disposed under the combustion gas descending chamber;

a smoke collecting chamber having a larger cross-sectional area than that of said exhaust port under the exhaust port; and a smoke exhaust port disposed below the smoke collecting chamber.

2. A liquid heating apparatus as claimed in claim 1 wherein the relation between the cross-sectional area D of the smoke collecting chamber and the cross-sectional area d of the exhaust port is expressed by the equation of $D \geqq \sqrt{1.5} \times d$.

3. A liquid heating apparatus as in claim 2, wherein the external drum is covered with a heat insulating material.

4. A liquid heating apparatus as in claim 1 or claim 2 wherein the smoke exhaust port is provided in the side section of at the bottom of the smoke collecting chamber.

5. A liquid heating apparatus as in claim 4 wherein the external drum is covered with a heat insulating material.

6. A liquid heating apparatus as in claim 1, wherein the external drum is covered with a heat insulating material.

7. A liquid heating apparatus, comprising:

a first metal vessel having a combustion chamber therein;

a second metal vessel disposed a spaced distance from and concentrically about the first metal vessel, wherein the space between the first and second metal vessels is an annular inner water chamber;

a third metal vessel disposed a spaced distance from and concentrically about the second metal vessel, wherein the space between the second and third metal vessels is an annular combustion gas descending chamber;

a fourth metal vessel disposed a spaced distance from and concentrically about the third metal vessel, sand fourth metal vessel having a cold water inlet port and a hot water outlet port, wherein the space between the third and fourth metal vessels is an annular outer water chamber;

a combustor in communication with the combustion chamber extending through the first, second, third and fourth metal walls;

a gas communicating port disposed between the first and second metal vessels, wherein the combustion chamber is in communication with the annular combustion gas descending chamber;

a water communicating port disposed between the second and third metal vessels, wherein the inner water chamber is in communication with the outer water chamber;

an exhaust port disposed between the third and fourth metal vessels;

a fifth metal vessel in communication with the combustion gas descending chamber through the exhaust port, wherein the space within the fifth metal vessel is a smoke collecting chamber, and wherein the cross-sectional area of the smoke collecting chamber, is greater than the cross-sectional area of the exhaust port; and a smoke exhaust port disposed in the fifth metal vessel.

8. The liquid heating apparatus of claim 7 further comprising a flue attached to the smoke exhaust port.

9. The liquid heating apparatus of claim 8 wherein the cross-sectional area of the smoke collecting chamber is expressed by the equation of $D \geqq (1.5)^{0.5} \times d$, wherein D is the diameter of the smoke collecting chamber and d is the diameter of the exhaust port.

* * * * *